US006595189B2

(12) United States Patent
Coldren et al.

(10) Patent No.: US 6,595,189 B2
(45) Date of Patent: Jul. 22, 2003

(54) METHOD OF REDUCING NOISE IN A MECHANICALLY ACTUATED FUEL INJECTION SYSTEM AND ENGINE USING SAME

(75) Inventors: Dana R. Coldren, Fairbury, IL (US); Steven J. Funke, Princeville, IL (US); George E. Donaldson, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/927,843

(22) Filed: Aug. 10, 2001

(65) Prior Publication Data

US 2003/0029421 A1 Feb. 13, 2003

(51) Int. Cl.[7] ..... F02M 55/00

(52) U.S. Cl. ..... 123/467; 123/468; 123/506; 123/459

(58) Field of Search ..... 123/467, 468, 123/458, 459, 490, 499, 506, 507, 508; 239/88–96, 588.5, 533.4

(56) References Cited

U.S. PATENT DOCUMENTS

| | | | | | |
|---|---|---|---|---|---|
| 4,064,855 | A | | 12/1977 | Johnson | |
| 4,077,376 | A | | 3/1978 | Thoma | |
| 4,598,863 | A | * | 7/1986 | Kanesaka | 239/94 |
| 4,627,571 | A | * | 12/1986 | Kato et al. | 123/467 |
| 4,784,101 | A | | 11/1988 | Iwanaga et al. | |
| 5,012,785 | A | | 5/1991 | Long et al. | |
| 5,156,132 | A | * | 10/1992 | Iwanaga | 123/496 |
| 5,159,911 | A | | 11/1992 | Williams et al. | |
| 5,176,120 | A | | 1/1993 | Takahashi | |
| 5,280,773 | A | | 1/1994 | Henkel | |
| 5,295,470 | A | | 3/1994 | Straubel | |
| 5,390,851 | A | * | 2/1995 | Long et al. | 239/126 |
| 5,441,029 | A | | 8/1995 | Hlousek | |
| 5,535,723 | A | * | 7/1996 | Gibson et al. | 123/446 |
| 5,551,398 | A | * | 9/1996 | Gibson et al. | 123/446 |
| 5,566,660 | A | * | 10/1996 | Camplin et al. | 123/299 |
| 5,628,293 | A | * | 5/1997 | Gibson et al. | 123/446 |
| 5,662,087 | A | * | 9/1997 | McCandless | 123/446 |
| 5,711,274 | A | | 1/1998 | Drummer | |
| 5,711,279 | A | | 1/1998 | Green et al. | |
| 5,743,237 | A | | 4/1998 | Matta | |
| 5,771,865 | A | | 6/1998 | Ishida | |
| 5,785,021 | A | * | 7/1998 | Yudanov et al. | 123/446 |
| 5,819,704 | A | | 10/1998 | Tarr et al. | |
| 5,873,527 | A | * | 2/1999 | Pattanaik et al. | 239/91 |
| 6,073,608 | A | * | 6/2000 | Krieger et al. | 123/299 |
| 6,113,014 | A | | 9/2000 | Coldren et al. | |
| 6,119,959 | A | * | 9/2000 | Smith et al. | 123/496 |
| 6,213,093 | B1 | * | 4/2001 | Yudanov et al. | 123/446 |
| 6,427,968 | B1 | | 8/2002 | Stoecklein | |
| 6,450,778 | B1 | * | 9/2002 | Spoolstra et al. | 123/458 |
| 2002/0185112 | A1 | * | 12/2002 | Lei | 123/446 |

FOREIGN PATENT DOCUMENTS

| | | |
|---|---|---|
| JP | 200297710 | 10/2000 |

* cited by examiner

*Primary Examiner*—Henry C. Yuen
*Assistant Examiner*—Hai Huynh
(74) *Attorney, Agent, or Firm*—Liell & McNeil

(57) ABSTRACT

The present invention finds application in engines using mechanically actuated electronically controlled fuel injectors having direct control needle valves. In valves such as these, a spill control valve member controls fuel pressurization within the injector while a needle control valve member controls the timing and duration of the injection event. However, when the momentum of fuel exiting the fuel injector past the spill valve is greater than that of the tappet and plunger moving toward their downward positions, engine components upstream of the tappet can briefly separate and re-engage, which can result in increased mechanical noise levels. Therefore, the present invention is directed to maintaining sufficient contact force in the various engine components to reduce the mechanical noise levels by positioning a flow restriction between the fuel pressurization chamber of the fuel injector and a fuel source.

20 Claims, 4 Drawing Sheets

METHOD OF REDUCING NOISE IN A MECHANICALLY ACTUATED FUEL INJECTION SYSTEM AND ENGINE USING SAME

TECHNICAL FIELD

This invention relates generally to mechanically actuated fuel injection systems, and more particularly to a method of reducing noise in a mechanically actuated fuel injection system.

BACKGROUND

In engines utilizing mechanically actuated electronically controlled fuel injectors, a tappet included on the mechanically actuated fuel injector is controlled in its movement by the reciprocating motion of a rocker arm in contact with the fuel injector. One example of such a fuel injector is disclosed in U.S. Pat. No. 6,113,014, which issued to Coldren et al. On Sep. 5, 2000. As the rocker arm is moved downward by movement of the rocker arm assembly and lifter arm assembly, a tappet included on the fuel injector is driven downward, causing a plunger included in said fuel injector to pressurize fuel for an injection event. As the rocker arm is moved upward, the tappet is allowed to return to an upward position under the action of a biasing spring, allowing fresh fuel to be drawn into the fuel injector for the next injection event.

In fuel injectors such as these, the timing and duration of the injection event is controlled by an electrically controlled needle control valve member that is movably positioned in the injector body, while timing of fuel pressurization within the fuel injector is controlled by an electrically controlled spill valve member. Prior to initiation of an injection event, the tappet begins its downward movement in response to movement of the rocker arm. When it is time for an injection event to commence, the spill valve member is moved to a position blocking the fuel pressurization chamber from a spill passage. The needle control valve member is then moved to a position blocking a closing hydraulic surface of the direct control needle valve from high pressure fluid, thus relieving pressure on the needle valve member. High pressure acting on an opening hydraulic surface of the needle valve can then reach a sufficient amount to lift the needle and allow fuel spray to begin. At the end of the injection event while the tappet is still being driven toward its downward position, the needle control valve member is moved to a position re-opening the closing hydraulic surface to high pressure fluid and the needle valve is moved to a closed position, blocking fuel spray. The injection event is ended by opening the fuel pressurization chamber to the spill passage, thus causing pressure within the injector body, including that acting on the opening hydraulic surface of the needle valve, to decrease. After the injection event has ended, the tappet continues to be driven to its downward position, and eventually begins to retract toward its upward position under the action of the rocker arm after the peak of the cam lobe is passed.

Because the tappet continues in its downward movement after the spill passage is open, the energy dissipation associated with the high rate of pressure decay can have a strong influence on the movement of various engine components positioned upstream from the tappet. For instance, when the momentum of the tappet toward its downward position is less than the momentum of fuel being forced out of the spill passage, those engine components upstream of the tappet can briefly separate and re-engage, which can result in increased mechanical noise levels. This separation can occur between such components as gear teeth, roller followers and cam lobes. The impacts caused by the separation and re-engaging of the components can also contribute to premature component wear and failure.

The present invention is directed to overcoming one or more of the problems as set forth above.

SUMMARY OF THE INVENTION

In one aspect of the present invention, a mechanically actuated direct control fuel injection system includes a plurality of mechanically actuated fuel injectors that have an injector body, each of said injector bodies defining a fuel pressurization chamber, a needle control chamber, a fuel inlet and a spill passage. A noise producing linkage couples each of said fuel injectors to an engine. A direct control needle valve is movably positioned in each of the plurality of fuel injectors and includes a closing hydraulic surface that is exposed to fluid pressure in the needle control chamber. A spill valve member is positioned in each of the plurality of fuel injectors and is movable between an open position in which the fuel pressurization chamber is open to the fuel inlet and a closed position in which the fuel pressurization chamber is blocked from the fuel inlet. A flow restriction is positioned in the spill passage and has a flow area that is sufficiently small to reduce noise produced by the noise producing linkage to below a predetermined noise level and sufficiently large to maintain energy losses due to said flow restriction below a predetermined level.

In another aspect of the present invention, an engine including noise reducing features includes a noise producing linkage that is operably coupled to a plurality of mechanically actuated fuel injectors. Each of the fuel injectors provides an injector body that defines a fuel pressurization chamber, a needle control chamber, a fuel inlet and a spill passage. A direct control needle valve is movably positioned in each of the fuel injectors and includes a closing hydraulic surface that is exposed to fluid pressure in the needle control chamber. A low pressure return line fluidly connects the fuel pressurization chamber to a source of fuel, wherein the spill passage is a portion of the low pressure return line. A spill valve member is positioned in each of the fuel injectors and is movable between an open position in which the fuel pressurization chamber is open to the fuel inlet and a closed position in which the fuel pressurization chamber is blocked from the fuel inlet. A flow restriction is positioned in the low pressure return line and has a flow area that is sufficiently small to reduce noise produced by the noise producing linkage to below a predetermined noise level and sufficiently large to maintain energy losses due to the flow restriction to below a predetermined loss level.

In yet another aspect of the present invention, a method of reducing noise in a mechanically actuated fuel injection system includes a step of providing a mechanically actuated fuel injection system that has a plurality of mechanically actuated fuel injectors that each have an injector body that defines a spill passage and a fuel pressurization chamber and includes a direct control needle valve, wherein each of the fuel injectors is coupled to an engine by a noise producing linkage. Noise produced by the noise producing linkage is reduced to below a predetermined noise level at least in part by restricting flow in the spill passage.

DETAILED DESCRIPTION

Figure 1:
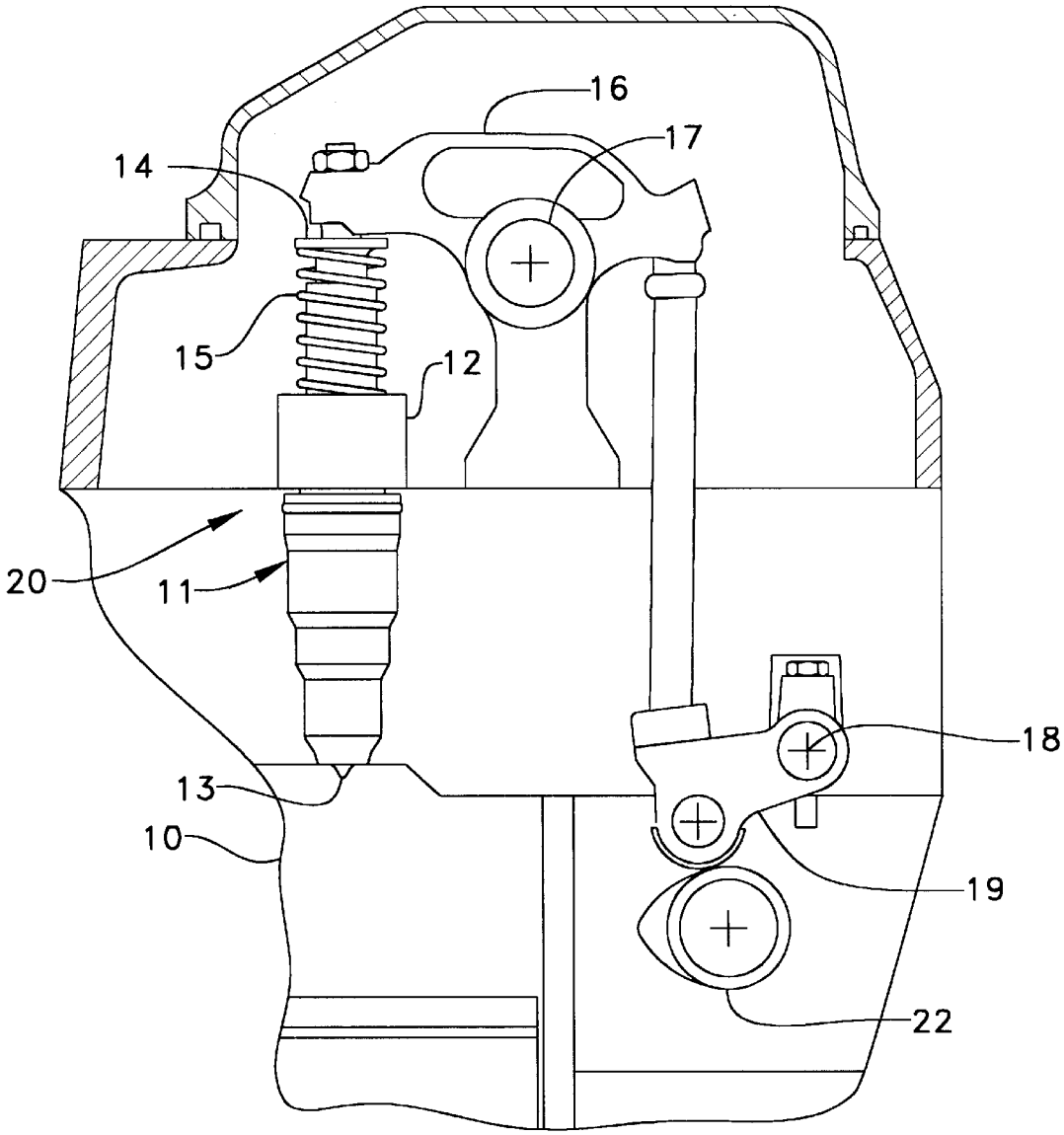
FIG. 1 is a sectioned side diagrammatic view of an engine with a fuel injector according to the present invention installed therein.

Referring now to FIG. 1, an engine 10 provides a fuel injection system 20 having a plurality of fuel injectors 11 (only one shown) installed such that each nozzle outlet 13 opens to an individual cylinder bore, as in a conventional diesel type engine. With each cycle of engine 10, a lifter assembly 19 is moved upward about lifter group shaft 18 by a cam 22 driven directly by the engine through a suitable linkage, such as gears, etc. Lifter assembly 19 acts upon rocker arm assembly 16, which is mounted to pivot about rocker arm shaft 17. A portion of rocker arm assembly 16 is in contact with a tappet 14 that is mated to injector body 12 of fuel injector 11. A compression spring 15 has one end in contact with injector body 12 and its other end in contact with tappet 14. Compression spring 15 normally pushes tappet 14 away from injector body 12, such that rocker arm assembly 16 maintains contact with tappet 14 in a conventional manner. With each power cycle of engine 10, tappet 14 is driven downward to move a plunger within injector body 12. The downward stroke of the plunger within fuel injector 11 pressurizes fuel so that fuel commences to spray out of nozzle outlet 13.

Figure 2:
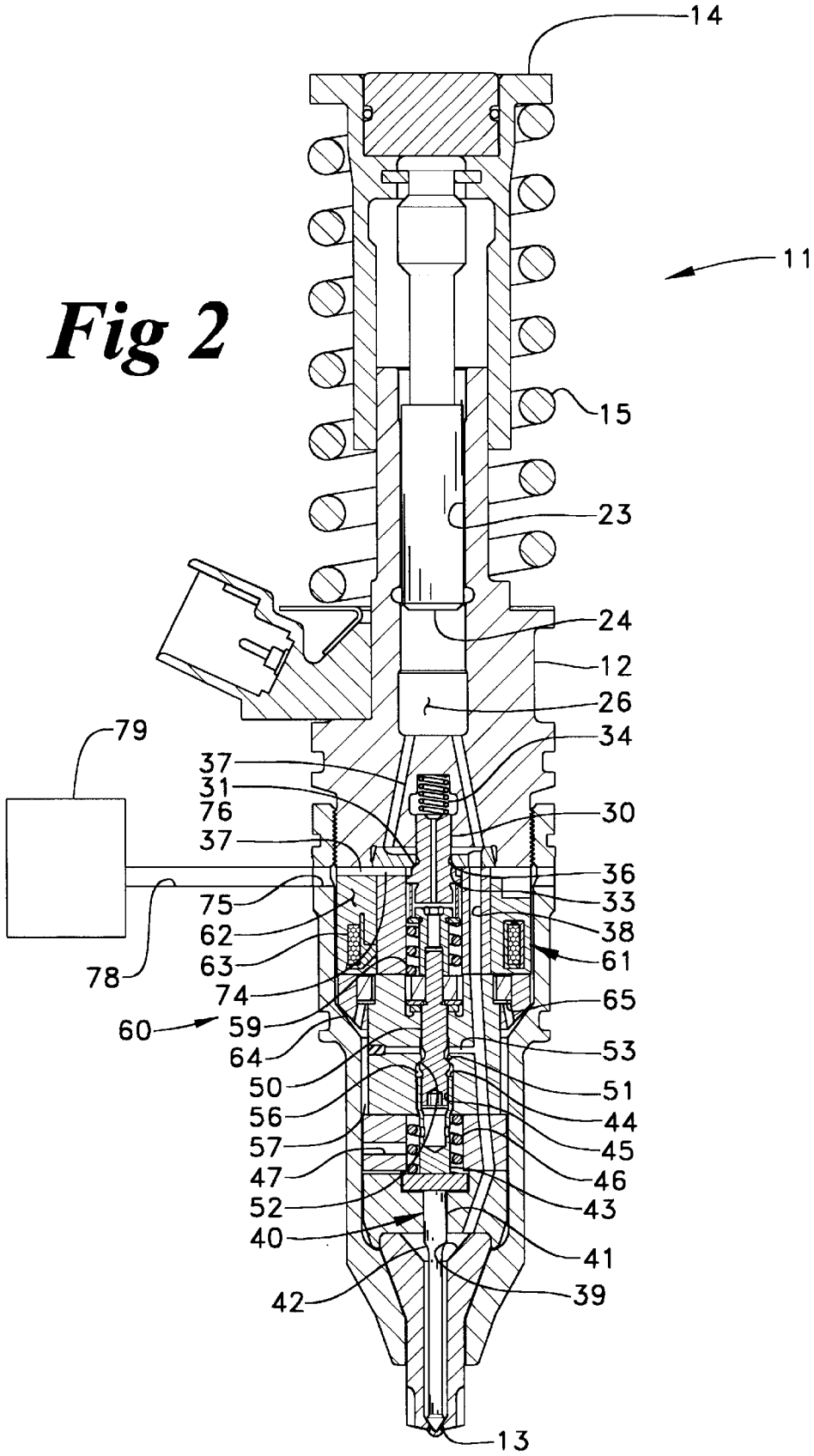
FIG. 2 is a sectioned side diagrammatic view of a mechanically actuated fuel injector according to the present invention.

Referring to FIG. 2 there is shown a sectioned side view of mechanically actuated fuel injector 11 according to the present invention. As illustrated, injector body 12 provides various moving components that are positioned as they would be just prior to an injection event. Tappet 14 is mounted about fuel injector 11 and is movable between an upward retracted position (as shown) and a downward advanced position. Tappet 14 is biased toward its retracted position by biasing spring 15. When rocker arm assembly 16 moves toward its downward position, it exerts a downward force on tappet 14 that moves tappet 14 toward its advanced position against the action of biasing spring 15. When rocker arm assembly 16 returns to its upward position, the force on tappet 14 is relieved so that the assembly returns to its retracted position under the action of biasing spring 15. Fuel injector 11 also provides a direct control needle valve 40 and a valve assembly 60 that control pressure within injector body 12 and injection event timing.

Valve assembly 60 provides a spill valve member 30 and a needle control valve member 50 which are controlled in movement by an electrical actuator, which in this example is a single pole solenoid assembly 61. Those skilled in the art will recognize that other electrical actuators, such as piezo electric actuators, could be used with the present invention. Solenoid assembly 61 is preferably a three position single pole solenoid assembly that includes a coil 63 positioned in a stator 62, a magnetic flux ring 64 and an armature 65. Stator 62, magnetic flux ring 64 and armature 65 are preferably manufactured from a suitable magnetically permeable material. Solenoid assembly 61 is preferably movable between a first, no current position, a second, low current position and a third, high current position. Spill valve member 30 is biased toward a downward position by a spill biasing spring 34, which also biases needle control valve member 50 toward a downward position together with a needle control biasing spring 59. The positioning of spill valve member 30 within injector body 12 controls the timing of fuel pressurization within fuel pressurization chamber 26 while the positioning of needle control valve member 50 controls the movement of direct control needle valve 40, thus controlling the timing and quantity of fuel injected by fuel injector 11.

Tappet 14 is operably coupled to a plunger 24 that is movable within a plunger bore 23 defined by injector body 12 between an upward, retracted position (as shown) and a downward, advanced position. A fuel pressurization chamber 26 is defined by one end of plunger 24 and a portion of plunger bore 23. Fuel pressurization chamber 26 is capable of fluid communication with nozzle outlet 13 via a nozzle supply passage 38 and a nozzle chamber 39. Fuel pressurization chamber 26 is also capable of fluid communication with a source of fuel 79 via a fuel inlet 75, a fuel supply passage (not shown) and a low pressure return line 74. Low pressure return line 74 preferably includes a fuel line 78 that is external to fuel injector 11 and a spill passage 37 that is defined by injector body 12. Fuel is preferably drawn into fuel pressurization chamber 26 between injection events when plunger 23 is returning to its retracted position from a fuel inlet 75 through spill passage 37 and also through the fuel supply passage past a check valve (not shown). When plunger 24 moves downward toward its advanced position, fluid pressure within fuel pressurization chamber 26 moves the check valve downward, thus blocking communication between fuel pressurization chamber 26 and fuel inlet 75 via the fuel supply passage. However, fuel can be displaced from fuel pressurization chamber 26 toward fuel inlet 75 via spill passage 37 when spill valve member 30 is in its downward, open position.

When spill valve member 30 is in its downward position, such as when solenoid assembly 61 is in a first position, as it is between injection events, a spill valve surface 31 included on spill valve member 30 is out of contact with a conical spill valve seat 33 included on injector body 12. When spill valve member 30 is in this position, fuel pressurization chamber 26 is open to fuel source 79 via low pressure return line 74. In other words, when spill valve member 30 is in its downward position, pressure within injector body 12, can decay. When solenoid assembly 61 is in its second and third positions, such as just prior to and during an injection event, spill valve member 30 is moved to an upward position. When spill valve member 30 is in this position, spill valve surface 31 is in contact with spill valve seat 33, such that fuel pressurization chamber 26 is blocked from fluid communication with fuel source 79.

As previously indicated, when spill valve member 30 is in its downward, open position, pressure within fuel injector 11 is low or being reduced. This reduction in pressure results in the end of the injection event. When this pressure decay is too rapid, the associated energy dissipation can cause various mechanical components upstream from tappet 14, such as rocker arm assembly 16 linkage assembly 19 and cam 22, to become separated briefly because tappet 14 is briefly moving toward its downward position faster than cam 22 is rotating to maintain the contact force between components in the system. This separation can produce a substantial amount of mechanical noise. In particular, separation of the roller follower from the cam and the gear teeth from the gear train contribute to the majority of the mechanical noise produced by this noise producing linkage. Therefore, a flow restriction 36 is preferably included in low pressure return line 74 to reduce the pressure decay rate in fuel injector 11 and to maintain sufficient stiffness in the system to reduce the separation between the various mechanical components. In other words, flow restriction 36 can reduce the momentum of fuel flowing out of spill passage 37 to reduce the downward momentum of tappet 14 in an effort to maintain the contact force between the various linkage components, which can reduce separation of the same. Flow restriction 36 is preferably defined as a flow area between spill valve surface 31 and spill valve seat 33 when spill valve member 30 is in its downward position. However, while flow restriction 36 has been illustrated in this manner, it should be appreciated that it could be defined by injector body 12 at any other point in spill passage 37. Further, flow restriction 36 could be defined outside of injector body 12 in fuel line 78. Therefore, it should be appreciated that flow restriction 36 could be positioned at any point in low pressure return line 74 between fuel pressurization chamber 26 and fuel source 79.

Figure 3A:
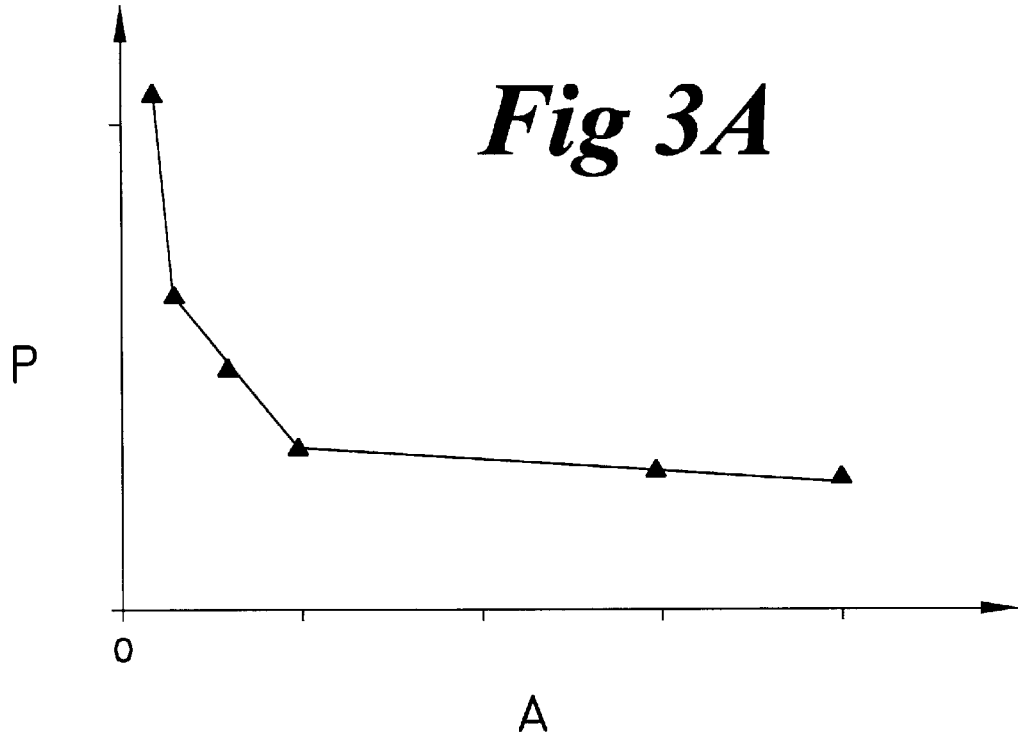
FIGS. 3*a–b* show parasitic power and percent reduction in injector train component separation, respectively, as a function of spill passage flow restriction area according to the present invention.
Figure 3B:
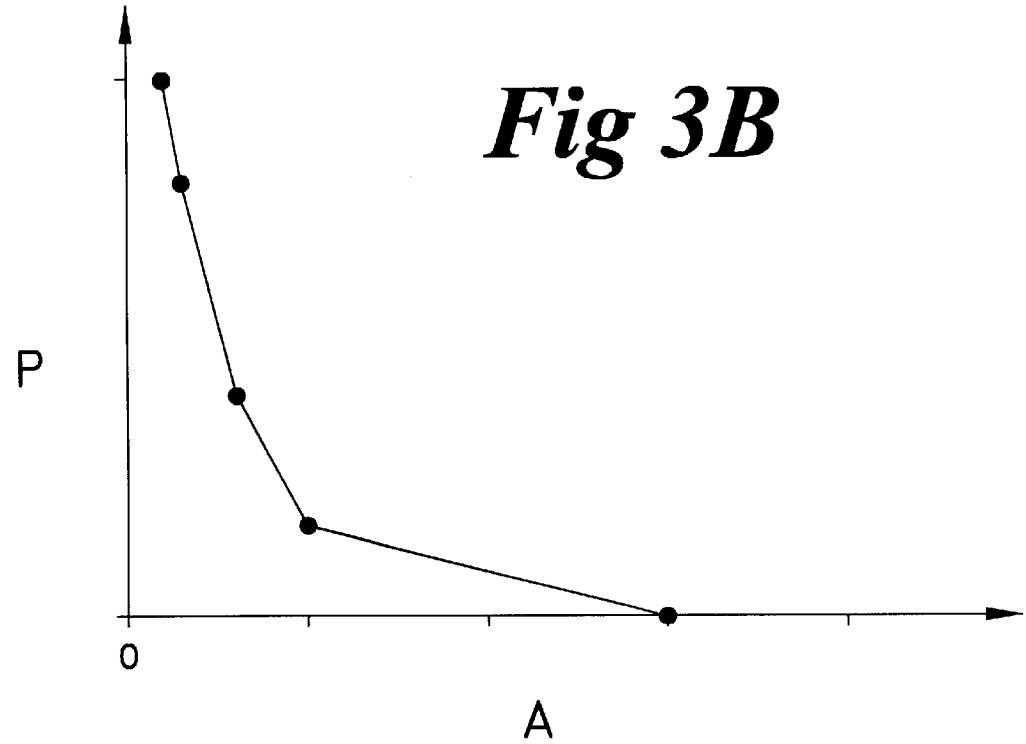

In addition to affecting noise produced by the noise producing linkage, the flow area of flow restriction 36 also affects the amount of fuel consumed, and an amount of energy lost, by engine 10. Referring in addition to FIGS. 3*a–b,* both parasitic power, FIG. 3*a,* and percent reduction in component separation, FIG. 3*b,* have been graphed versus flow area of flow restriction 36. As illustrated in FIG. 3*b,* the smaller the flow area of flow restriction 36, the higher the percent reduction in separation of mechanical components upstream of tappet 14, which corresponds to a greater reduction in mechanical noise. Therefore, as the flow area of flow restriction 36 is decreased from 15 $mm^2$ to approach 0 $mm^2$, there is a corresponding increase in the percent reduction of component separation that approaches one hundred percent. However, as illustrated in FIG. 3*a,* as the flow area of flow restriction 36 is reduced, the parasitic power, which is directly related to fuel consumption, is increased. In other words, as the flow area of flow restriction 36 is reduced from 15 $mm^2$ to approach 0 $mm^2$, the parasitic power increases from 1.2 kW/cycle to 1.5 kW/cycle. This increase in fuel consumption corresponds to an increase in engine energy that is lost, or wasted, due to flow restriction 36. In other words, the engine has to work harder to push the fuel through a smaller restriction. Therefore, the flow area of flow restriction 36 is preferably determined by balancing noise considerations with desired fuel consumption. In other words, the flow area of flow restriction 36 is preferably determined such that mechanical noise due to pressure decay is decreased to below an acceptable noise level, while energy losses associated with flow restriction 36 are maintained below an acceptable loss level.

As a further illustration, if engine 10 is to be used in a predominantly urban area where noise levels are a very important concern, a high fuel consumption rate or energy loss rate might be acceptable in order to create a greater reduction of mechanical noise levels. Here, flow restriction 36 might have a flow area that approaches 2 $mm^2$. However, if engine 10 is to be used predominantly for highway applications, where fuel consumption and energy losses are much more pressing concerns than noise reduction, a small amount of noise reduction could be achieved while only slightly increasing the amount of fuel consumed. In this case, the flow area of flow restriction 36 could be closer to 15 $mm^2$.

Returning to fuel injector 11, when solenoid assembly 61 is in its first position, needle control valve member 50 is in its biased downward position to open nozzle supply passage 38 to a needle control chamber 56 via a pressure communication passage 53, thus exposing a closing hydraulic surface 44 of needle valve member 41 to high pressure fluid. When solenoid assembly 61 is in its second, low current position, needle control valve member 50 moves upward as does spill valve member 30. However, because the biasing strength of needle control biasing spring 59 is preferably stronger than that of spill biasing spring 34, this low amount of current is preferably not sufficient to cause needle control valve member 50 to be moved to its upward position. Thus when plunger 24 is undergoing its downward stroke, fuel pressure can build within fuel pressurization chamber 26 while needle valve 40 is held in its closed position by the high pressure acting on closing hydraulic surface 44. When solenoid assembly 61 is in its third, high current position, such as just prior to an injection event, needle control valve member 50 is moved to its upward position to block needle control chamber 56 from fluid communication with nozzle supply passage 38, thus blocking closing hydraulic surface 44 of needle valve 40 from high pressure fluid in pressure communication passage 53. When needle control valve member 50 is in its upward, closed position, pressure within needle control chamber 56 becomes relatively low due to a vent clearance 45 that exists between the outer surface of a piston portion 43 of needle valve 40 and the outer surface of needle control valve member 50, and a vent passage 47 that opens to an annular low pressure area 57 in fluid contact with fuel inlet 75.

As previously indicated, the movement of needle control valve member 50 controls the positioning of direct control needle valve 40. In addition to piston portion 43 which provides closing hydraulic surface 44, direct control needle valve 40 has a needle valve member 41 that provides an opening hydraulic surface 42 which is exposed to fluid pressure in a nozzle chamber 39. Direct control needle valve 40 is biased toward a downward, closed position by a needle biasing spring 46. When needle valve 40 is in this position, nozzle outlet 13 is blocked from fluid communication with nozzle supply passage 38. Opening hydraulic surface 42, closing hydraulic surface 44 and the strength of biasing spring 46 are preferably selected such that needle valve 40 will remain in its closed position when pressure in needle control chamber 56 is high. In other words, these features are preferably selected to allow needle valve 40 to move toward or remain in its closed position when needle control valve member 50 is in its downward, open position. When pressure in needle control chamber 56 is low, such as when needle control valve member 50 is in its upward, closed position, direct control needle valve 40 acts as a spring biased check. Under these conditions, needle valve 40 will move toward its upward, open position when the hydraulic pressure force acting on opening hydraulic surface 42 is sufficient to overcome the force of needle biasing spring 46.

INDUSTRIAL APPLICABILITY

Referring to FIGS. 1–2, just prior to an injection event, lifter arm assembly 19 is in its downward position such that rocker arm assembly 16 is in an upward position exerting a minimum amount of force on tappet 14. Tappet 14 and plunger 24 are in their upward positions and needle valve member 40 is in its closed position blocking nozzle outlet 13 from nozzle supply passage 38. Spill valve member 30 is in its downward position opening fuel pressurization chamber 26 to spill passage 37 and needle control valve member 50 is in its downward position opening pressure communication passage 53 to needle control chamber 56. The injection event is initiated when lifter assembly 19 moves upward about lifter group shaft 18 due to the rotation of cam 22. Lifter assembly 19 then acts upon rocker arm assembly 16, and pivots the same downward about rocker arm shaft 17. When rocker arm assembly 16 begins to pivot, it exerts a downward force on tappet 14 which is moved toward its advanced position against the action of biasing spring 15.

When tappet 14 begins to move downward toward its advanced position, plunger 24 begins to move toward its advanced position in a corresponding manner. Solenoid assembly 61 is then activated to move from its first position to its second, low current position and armature 65 moves spill valve member 30 to its upward position closing spill valve seat 33 and blocking fuel pressurization chamber 26 from spill passage 37. Recall that needle control valve member 50 also moves upward at this time, however, it does not move up far enough for pressure communication passage 53 to be blocked from needle control chamber 56. As plunger 24 moves downward, it pressurizes the fuel within fuel pressurization chamber 26 and nozzle supply passage 38. Just prior to the desired time for fuel injection, solenoid assembly 61 is activated to its third, higher current position and needle control valve member 50 is moved to its upward position by armature 65 to allow needle control valve surface 51 to close needle control valve seat 52, blocking needle control chamber 56 from the high pressure fuel in nozzle supply passage 38. Pressure acting on opening hydraulic surface 42 within nozzle chamber 39 continues to rise as plunger 24 advances. When the pressure exerted on opening hydraulic surface 42 exceeds a valve opening pressure, needle valve 40 is lifted to its upward position to open nozzle outlet 13. High pressure fuel within nozzle supply passage 38 can now spray into the combustion chamber.

Just prior to the end of an injection event, while tappet 14 and plunger 24 are still moving toward their downward positions, current to solenoid assembly 61 is terminated. This allows needle control valve member 50 to return to its biased, downward position to re-open needle control chamber 56 to pressure communication passage 53. High pressure fuel flowing into needle control chamber 56 now acts on closing hydraulic surface 44 to push needle valve 40 to its downward position closing nozzle outlet 13 from nozzle supply passage 38 and ending fuel spray into the combustion space. At about the same time, spill valve member 30 moves to its biased, downward position to open fuel pressurization chamber 26 to fuel inlet 75 via spill passage 37 to allow fuel pressure within fuel pressurization chamber 26 and nozzle supply passage 38 to be vented. Because the flow area between spill valve surface 31 and spill valve seat 33 define a flow restriction 36, recall that the decay rate of pressure within fuel pressurization chamber 26 and nozzle supply passage 38 will be decreased thus reducing the momentum of fuel exiting fuel injector 11 via spill passage 37. Depending upon the flow area of flow restriction 36, the momentum of fuel flowing through spill passage 37 can be reduced to approach the downward momentum of tappet 14 to maintain contact force in upstream engine components, such as the rocker arm assembly and the follower arm assembly. This increased contact force can result in the desired reduction in noise while maintaining the amount of fuel consumption, and therefore energy loss, to below a predetermined, acceptable loss level.

Once the injection event is ended, various components of fuel injector 11 can be reset in preparation for the next injection event. Having reached its upward position after fuel spray into the combustion space ended, lifter arm assembly 19 begins to move toward its downward position about lifter group shaft 18. This results in an upward movement of rocker arm assembly 16 about rocker shaft 17. As rocker arm assembly 16 moves upward, tappet 14 and plunger 24 move upward in a corresponding manner.

Figure 4A:
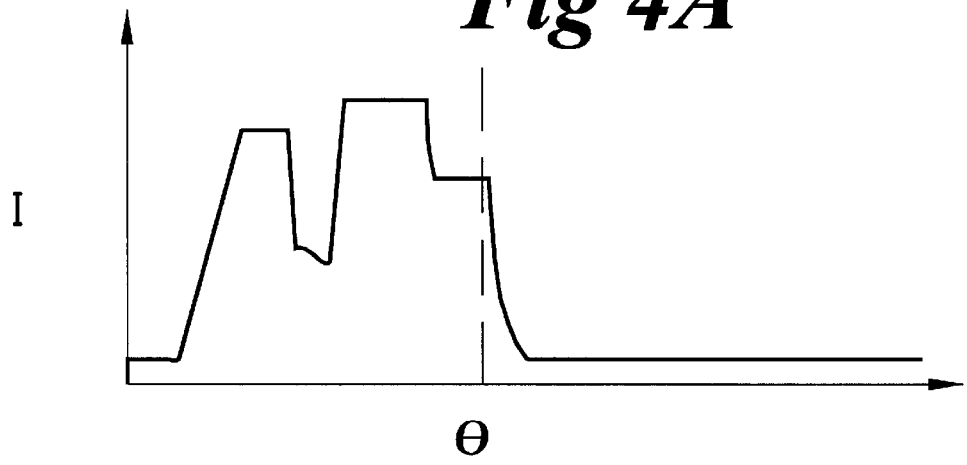
FIGS. 4*a–c* show current to the solenoid, chamber pressure and mass flow rate, respectively, graphed versus crank angle for an injection event according to the present invention.
Figure 4B:
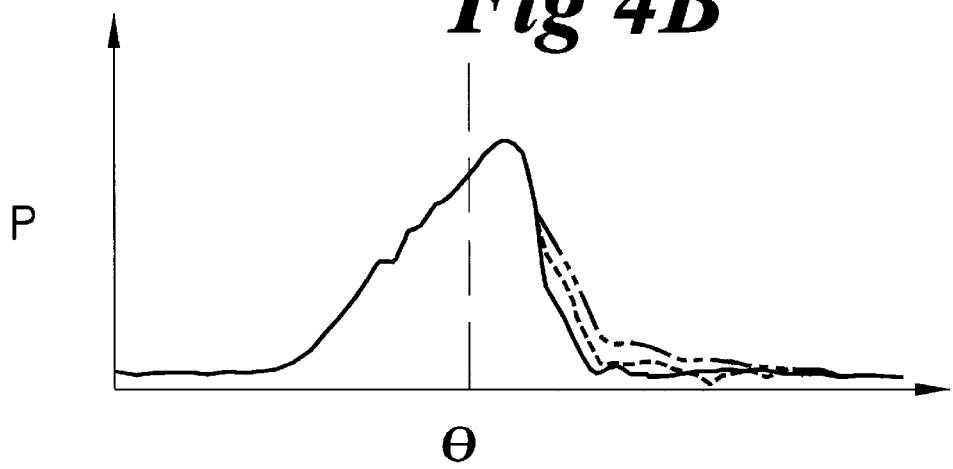
Figure 4C:
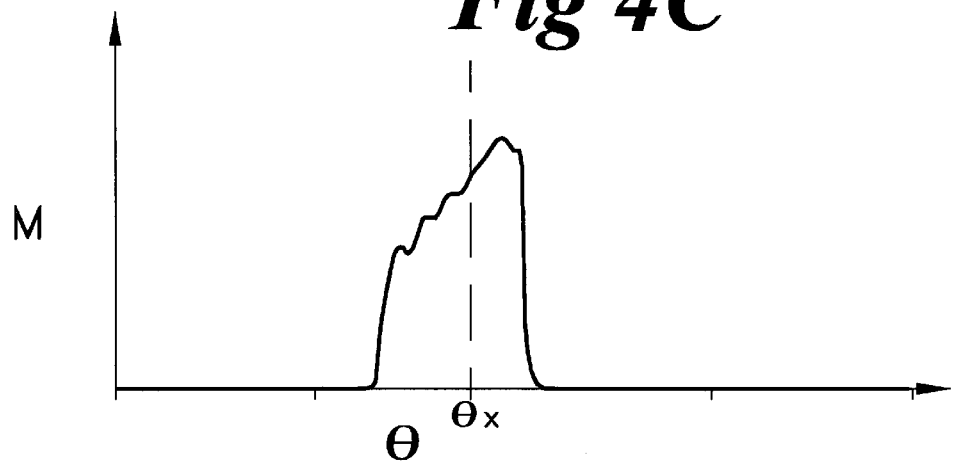

It should be appreciated that because independently controlled needle control valve member 50 is included in fuel injector 11 to control the movement of needle valve 40, the flow area of flow restriction 36 can be determined without concerns for detrimental effect on the end of an injection event. Referring to FIGS. 4*a,* 4*b,* and 4*c,* current (I) to solenoid assembly 61, pressure (P) in fuel pressurization chamber 26 and mass flow rate (M) have been graphed, respectively, versus crank angle for an injection event. These injection characteristics have been graphed for flow restriction 36 having a relatively large flow area, on the order of 20 $mm^2$, a relatively small flow area, on the order of 1.5 $mm^2$, and a slightly smaller flow area, on the order of 1 $mm^2$. These are represented in FIGS. 4*a–c* as the solid line, the dashed line and the broken line, respectively. As illustrated, alteration of the flow area of flow restriction 36 has no noticeable effect on the mass flow rate of the injection event, as expected. However, as best illustrated in FIG. 4*b,* reduction in the flow area of flow restriction 36 does reduce the rate of pressure decay within fuel pressurization chamber 26. Recall that the reduction of the rate of pressure decay within fuel pressurization chamber 26 is accompanied by a corresponding increase in the amount of energy lost, or wasted, during this portion of the injection event. This lost energy is represented as the area under the pressure curve of FIG. 4*b* from $\Theta_x$, corresponding to the crank angle when current to solenoid assembly 61 is ended to end the injection event, until the end of pressure decay within fuel injector 11. As illustrated in FIG. 4*b,* the higher rate of pressure decay produced when the flow area of flow restriction 36 is 20 $mm^2$ (represented by the solid line graph), corresponds to a smaller amount of lost energy than the lower rate of pressure decay produced when the flow area of flow restriction 36 is 1 $mm^2$ (represented by the broken line graph).

The present invention utilizes a flow restriction 36 positioned between fuel pressurization chamber 26 and fuel source 79 to reduce the pressure decay rate within fuel injector 11 at the end of an injection event. By reducing the pressure decay rate, the momentum of fuel flow out of spill passage 37 can be reduced to approach the downward momentum of tappet 14. The result is an increased contact force in the mechanical components upstream from tappet 14. Separation of certain linkage components, in particular the roller follower from the cam and the gear teeth from the gear linkage, can therefore be reduced as a result of this increased contact force between the mechanical components. This reduction in separation can reduce the mechanical noise that is produced between injection events. The flow area of flow restriction 36 is preferably determined by balancing an acceptable reduction in noise levels with an acceptable amount of fuel consumption, or energy loss resulting from the flow restriction. Because the end of an injection event is controlled by independently controlled needle control valve member 50, the flow area of flow restriction 36 can be determined without concerns for detrimental effect on the end of an injection event.

It should be understood that the above description is intended for illustrative purposes only, and is not intended to limit the scope of the present invention in any way. For instance, while the flow restriction of the present invention has been illustrated as being defined by a flow area between the spill valve member and a spill valve seat, it should be appreciated that the flow restriction could instead be positioned at any point between the fuel pressurization chamber and the fuel source. Thus, those skilled in the art will appreciate that other aspects, objects and advantages of this invention can be obtained from a study of the drawings, the disclosure and the appended claims.

What is claimed is:

1. A mechanically actuated direct control fuel injection system comprising:

a plurality of mechanically actuated fuel injectors including an injector body, each of said injector bodies defining a fuel pressurization chamber, a needle control chamber, a fuel inlet and a spill passage;

a noise producing linkage coupling each of said fuel injectors to an engine;

a direct control needle valve being movably positioned in each of said plurality of fuel injectors and including a closing hydraulic surface exposed to fluid pressure in said needle control chamber;

a spill valve member being positioned in each of said plurality of fuel injectors and being movable between an open position in which said fuel pressurization chamber is open to said fuel inlet and a closed position in which said fuel pressurization chamber is blocked from said fuel inlet; and a flow restriction positioned in said spill passage and having a flow area sufficiently small to reduce noise produced by said noise producing linkage to below a predetermined noise level and sufficiently large to maintain energy losses due to said flow restriction below a predetermined loss level.

2. The mechanically actuated direct control fuel injection system of claim 1 wherein said flow restriction is defined by a flow area between said spill valve member and said injector body.

3. The mechanically actuated direct control fuel injection system of claim 1 wherein said spill valve member includes a valve surface and said injector body defines a conical valve seat; and said flow restriction is defined by a flow area between said valve surface and said conical valve seat when said spill valve member is away from said closed position.

4. The mechanically actuated direct control fuel injection system of claim 1 wherein each of said injector bodies defines a fuel supply passage fluidly connecting said fuel inlet to said fuel pressurization chamber; and a valve is positioned in said fuel supply passage.

5. The mechanically actuated direct control fuel injection system of claim 4 wherein said valve is a check valve.

6. The mechanically actuated direct control fuel injection system of claim 1 wherein each of said fuel injectors includes an electrical actuator operably connected to a needle control valve member and said spill valve member.

7. The mechanically actuated direct control fuel injection system of claim 6 wherein said electrical actuator has a first position in which said spill valve member is out of contact with a first valve seat defined by said injector body and said needle control valve member is out of contact with a second valve seat defined by said injector body;

said electrical actuator has a second position in which said spill valve member is in contact with said first valve seat and said needle control valve member is out of contact with said second valve seat; and said electrical actuator has a third position in which said spill valve member is in contact with said first valve seat and said needle control valve member is in contact with said second valve seat.

8. The mechanically actuated direct control fuel injection system of claim 1 wherein said flow area is less than 15 $mm^2$.

9. An engine with noise reduction features comprising:

a noise producing linkage being operably coupled to a plurality of mechanically actuated fuel injectors;

each of said fuel injectors including an injector body that defines a fuel pressurization chamber, a needle control chamber, a fuel inlet and a spill passage;

a direct control needle valve being movably positioned in each of said fuel injectors and including a closing hydraulic surface being exposed to fluid pressure in said needle control chamber;

a low pressure return line fluidly connecting said fuel pressurization chamber to a fuel source, wherein said spill passage is a portion of said low pressure return line;

a spill valve member being positioned in each of said fuel injectors and being movable between an open position in which said fuel pressurization chamber is open to said fuel inlet and a closed position in which said fuel pressurization chamber is blocked from said fuel inlet; and a flow restriction positioned in said low pressure return line and having a flow area sufficiently small to reduce noise produced by said noise producing linkage to below a predetermined noise level and sufficiently large to maintain energy losses due to said flow restriction below a predetermined loss level.

10. The engine of claim 9 wherein said flow restriction is positioned in said spill passage.

11. The engine of claim 10 wherein said flow restriction is defined by a flow area between said spill valve member and said injector body.

12. The engine of claim 11 wherein said spill valve member includes a valve surface and said injector body defines a conical valve seat; and said flow restriction is defined by a flow area between said valve surface and said conical valve seat when said spill valve member is away from said closed position.

13. The engine of claim 12 wherein each of said fuel injectors includes an electrical actuator operably connected to a needle control valve member and said spill valve member.

14. The engine of claim 13 wherein said conical valve seat is a first valve seat and said injector body defines a second valve seat;

said electrical actuator has a first position in which said spill valve member is out of contact with said first valve seat and said needle control valve member is out of contact with said second valve seat;

said electrical actuator has a second position in which said spill valve member is in contact with said first valve seat and said needle control valve member is out of contact with said second valve seat; and said electrical actuator has a third position in which said spill valve member is in contact with said first valve seat and said needle control valve member is in contact with said second valve seat.

15. The engine of claim 14 wherein each of said injector bodies defines a fuel supply passage between a fuel inlet and said fuel pressurization chamber; and a check valve is positioned in said fuel supply passage.

16. The engine of claim 15 wherein said flow area is less than 15 $mm^2$.

17. A method of reducing noise in a mechanically actuated fuel injection system comprising:

providing a mechanically actuated fuel injection system including a plurality of mechanically actuated fuel injectors each having an injector body defining a spill passage and a fuel pressurization chamber and including a direct control needle valve, wherein each of said fuel injectors is coupled to an engine by a noise producing linkage; and reducing noise produced by said noise producing linkage to below a predetermined noise level at least in part by restricting flow in said spill passage.

18. The method of claim 17 wherein said injector body defines a fuel inlet and includes a movable spill valve member; and said step of restricting flow in said spill passage includes a step of moving said spill valve member to an open position.

19. The method of claim 18 wherein said spill valve member defines a valve surface and said injector body defines a conical valve seat; and said step of restricting flow in said spill passage includes a step of defining a flow restriction to be a flow area between said valve surface and said conical valve seat.

20. The method of claim 19 wherein each of said fuel injectors include an electrical actuator and a needle control valve member having a control valve surface;

said conical valve seat being a first valve seat and each of said injector bodies defining a second valve seat; and including the steps of moving said electrical actuator to a first position in which said spill valve surface is out of contact with said first valve seat and said control valve surface is out of contact with said second valve seat;

moving said electrical actuator to a second position in which said spill valve surface is in contact with said first valve seat and said control valve surface is out of contact with said second valve seat; and moving said electrical actuator to a third position in which said spill valve surface is in contact with said first valve seat and said control valve surface is in contact with said second valve seat.

* * * * *